US005552873A

United States Patent [19]

Hirao et al.

[11] Patent Number: 5,552,873

[45] Date of Patent: Sep. 3, 1996

[54] ELECTROPHOTOGRAPHIC IMAGE FORMING APPARATUS HAVING A PRE-TRANSFER PRESSING ROLLER

[75] Inventors: Naoto Hirao; Shinji Ohshima, both of Kawasaki, Japan

[73] Assignee: Fujitsu Limited, Kawasaki, Japan

[21] Appl. No.: 196,530

[22] Filed: Feb. 15, 1994

Related U.S. Application Data

[63] Continuation-in-part of Ser. No. 15,447, Feb. 9, 1993, abandoned.

[30] Foreign Application Priority Data

Feb. 16, 1993 [JP] Japan ..... 5-26653

[51] Int. Cl.[6] ..... G03G 15/14

[52] U.S. Cl. ..... 355/274; 355/271

[58] Field of Search ..... 355/271, 273, 355/274, 312, 318, 319

[56] References Cited

U.S. PATENT DOCUMENTS 4,882,606 11/1989 Deguchi ..... 355/274
4,947,214 8/1990 Baxendell et al. ..... 355/274
5,031,002 7/1991 Yaguchi ..... 355/312
5,138,396 8/1992 Satou et al. ..... 355/308

FOREIGN PATENT DOCUMENTS 4-156578 5/1992 Japan .

*Primary Examiner*—Nestor R. Ramirez
*Attorney, Agent, or Firm*—Armstrong, Westerman, Hattori, McLeland & Naughton

[57] ABSTRACT

An electrophotographic image forming apparatus suitable especially for double-side printing or double-side copying. A pressure roller for pressing a sheet of paper against an electrostatic latent image retaining body is rotatably provided on the upstream side of a transfer unit. The pressure roller is elastically mounted through a cushion member, thereby preventing transmission of vibration of the pressure roller itself to the paper. As the paper is positively pressed against the retaining body by the pressure roller, the paper can be brought into close contact with the retaining body even when the paper is wrinkled, thus obtaining a good transfer characteristic.

13 Claims, 8 Drawing Sheets

ELECTROPHOTOGRAPHIC IMAGE FORMING APPARATUS HAVING A PRE-TRANSFER PRESSING ROLLER

CROSS REFERENCE TO RELATED APPLICATION

This application is a continuation-in-part of application Ser. No. 08/015,447, filed on Feb. 9, 1993, now abandoned.

BACKGROUND OF THE INVENTION

1. Field of the Invention

The present invention relates to an electrophotographic image forming apparatus such as an electrophotographic printer or an electrophotographic copying machine.

2. Description of the Related Art

In response to a recent increase in operating speed of a computer system, high speed and high reliability are demanded also in a printer as an output device for the computer system. In particular, an electrophotographic printer is expected as a printer meeting this demand. Initially, an optical fiber tube formed by integrating a flat cathode ray tube and an optical fiber array has been used as a light source for such an electrophotographic printer. The optical fiber tube has a merit such that a resolution thereof is high. However, it has defects such that small sizing of the light source is difficult and it is susceptible to an external magnetic flux. Further, a flying spot tube has also been proposed as a light source for a printer. However, since it has the same defects as those of the optical fiber tube, there are little cases utilized as a light source for a printer at present.

It is known that a laser beam printer and an LED array printer are widely used as an electrophotographic printer at present. In the laser beam printer, a laser beam is reflected by a polygonal mirror rotating at high speeds, and is scanned on a photosensitive body. Accordingly, high-speed printing can be effected. However, since the polygonal mirror is employed, an optical path is necessary to make it difficult to construct the printer as a whole in a small size.

In the LED array printer, a plurality of very small LEDs are arranged in array. Light emission from each LED is Controlled according to an image signal, and is applied directly or through a suitable optical system to a photosensitive body. The LED array printer has a defect that it is somewhat costly. However, since it has no mechanically movable parts, small sizing of the printer can be effected, and high speed can also be effected.

In an electrophotographic printer such as a laser beam printer or an LED array printer, a photosensitive drum is first uniformly charged with a given polarity. Then, the photosensitive drum is exposed to light according to image information to form an electrostatic latent image on the photosensitive drum. Then, the electrostatic latent image is developed by using a toner charged with the same polarity as that of the photosensitive drum. That is, the toner is electrostatically attached to an exposed portion of the photosensitive drum, thus forming a toner image on the photosensitive drum.

Then, the toner image on the photosensitive drum is transferred onto a sheet of paper normally by a transfer corotron in a transfer station. That is, the sheet of paper is guided to the toner image formed on the photosensitive drum, and DC corona discharge with a polarity reverse to that of the toner is normally applied by the transfer corotron to the paper from the back side thereof, thereby bringing the paper into close contact with the photosensitive drum and simultaneously electrostatically transferring the toner on the photosensitive drum to the paper. Then, AC corona discharge is applied by a separation corotron to the paper from the back side thereof, thereby separating the paper from the photosensitive drum. The paper thus separated from the photosensitive drum is fed to a fuser by a paper feeder, and the toner image on the paper is fused by the fuser, thereby obtaining a permanent image on the paper.

Recently, double-side printing in which permanent images are printed on both surfaces of the paper has been highly demanded. In performing such double-side printing, it is necessary to invert the paper in a paper inverting unit after fusing the toner image transferred to a first surface of the paper and then electrostatically attach the inverted paper to the photosensitive drum again. However, when the toner image formed on the first surface of the paper is fused by the fuser such as a flash fusing system employing a xenon lamp or the like, the paper is dried to be hardened and wrinkled. Accordingly, in electrostatically attaching the inverted paper having the permanent image on its first surface to the photosensitive drum by using the transfer corotron, a second surface of the paper is not brought into close contact with the photosensitive drum, causing a deterioration in transfer characteristic. As a result, a print quality is deteriorated.

SUMMARY OF THE INVENTION

It is therefore an object of the present invention to provide an electrophotographic image forming apparatus which can improve a print quality or a copy quality.

It is another object of the present invention to provide an electrophotographic image forming apparatus which is suitable to form a print image or a copy image on both surfaces of a sheet of paper.

In accordance with an aspect of the present invention, there is provided an image forming apparatus comprising an electrostatic latent image retaining body, means for forming an electrostatic latent image on said retaining body, means for developing said electrostatic latent image to form a toner image on said retaining body, means for transferring said toner image from said retaining body to a sheet of paper, means for separating from said retaining body said sheet of paper to which said toner image has been transferred by said transferring means, means for fusing said toner image on said sheet of paper, and a pressure roller rotatably and elastically provided on an upstream side of said transferring means, for pressing said sheet of paper against said retaining body.

Preferably, the image forming apparatus further comprises paper inverting means for inverting said sheet of paper after said toner image on a first surface of said sheet of paper is fused by said fusing means; and inversion path means for supplying said sheet of paper inverted by said paper inverting means to a position between said retaining body and said pressure roller.

It is also preferable that the pressure roller comprises a pair of large diameter portions spaced from each other and adapted to contact said retaining body at opposite end portions thereof; and a small diameter portion extending between said large diameter portions, wherein a difference in diameter between each of said large diameter portions and said small diameter portion is set to be slightly smaller than a thickness of said sheet of paper.

In accordance with another aspect of the present invention, there is provided an image forming apparatus, comprising: an electrostatic latent image retaining body; means for forming an electrostatic latent image on said retaining body; means for developing said electrostatic latent image to form a toner image on said retaining body; transfer means for transferring said toner image from said retaining body to a sheet of paper; means for separating from aid retaining body said sheet of paper to which said toner image has been transferred by said transfer means; means for fixing said toner image on said sheet of paper; paper guide means, provided on an upstream side of said transfer means, for guiding said sheet of paper to contact with said electrostatic latent image retaining body, said paper guide means including a lower paper guide and an upper paper guide defining a paper path therebetween; a pair of gap regulating means, provided at leading end portions of said lower paper guide on both sides thereof, for regulating a gap between said retaining body and a leading end of said lower paper guide to become less than a thickness of said sheet of paper; and biasing means for directly biasing the leading end of said lower paper guide onto said sheet of paper against said retaining body, a biasing force of said biasing means being weak enough to allow said lower paper guide to move away from said retaining body against the biasing force of said biasing means when said sheet of paper is introduced between said retaining body and the leading end of said lower paper guide.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

A preferred embodiment of the present invention will now be described in detail with reference to the drawings.

Figure 1:
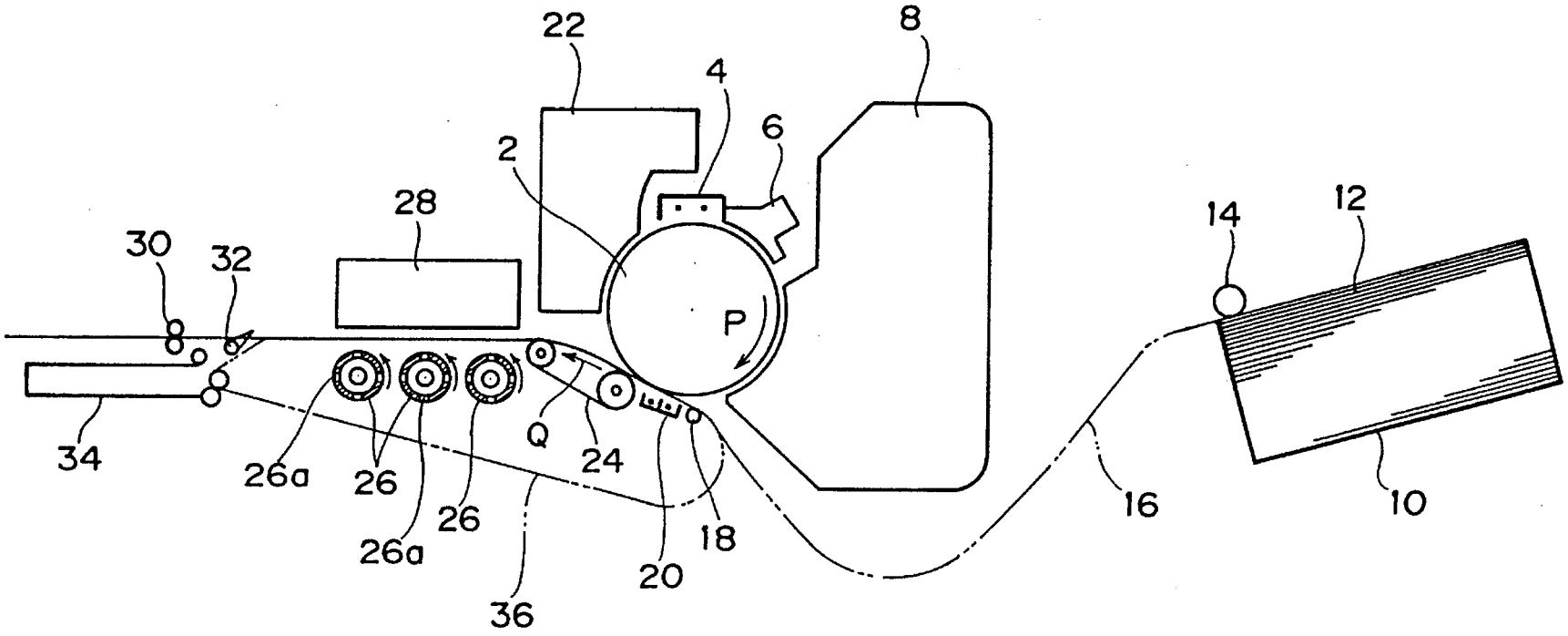
FIG. 1 is a schematic side view of an electrophotographic printer according to a preferred embodiment of the present invention.

Referring first to FIG. 1, there is shown a schematic side view of an electrophotographic printer according to the preferred embodiment of the present invention. A photosensitive drum 2 is adapted to be driven to rotate in a direction depicted by an arrow P in FIG. 1. The photosensitive drum 2 is formed of amorphous silicon, for example. The photosensitive drum 2 is uniformly charged with a predetermined polarity by a charging corotron 4. An electrostatic latent image is formed on the charged photosensitive drum 2 by a print head 6 according to image information. The print head 6 is constructed of an array of plural LEDs arranged in an axial direction of the photosensitive drum 2, for example. The electrostatic latent image formed on the photosensitive drum 2 is then developed by a developing device 8 with use of a toner charged with the same polarity as that of the charged photosensitive drum 2, thereby forming a toner image on the charged photosensitive drum 2.

Figure 2:
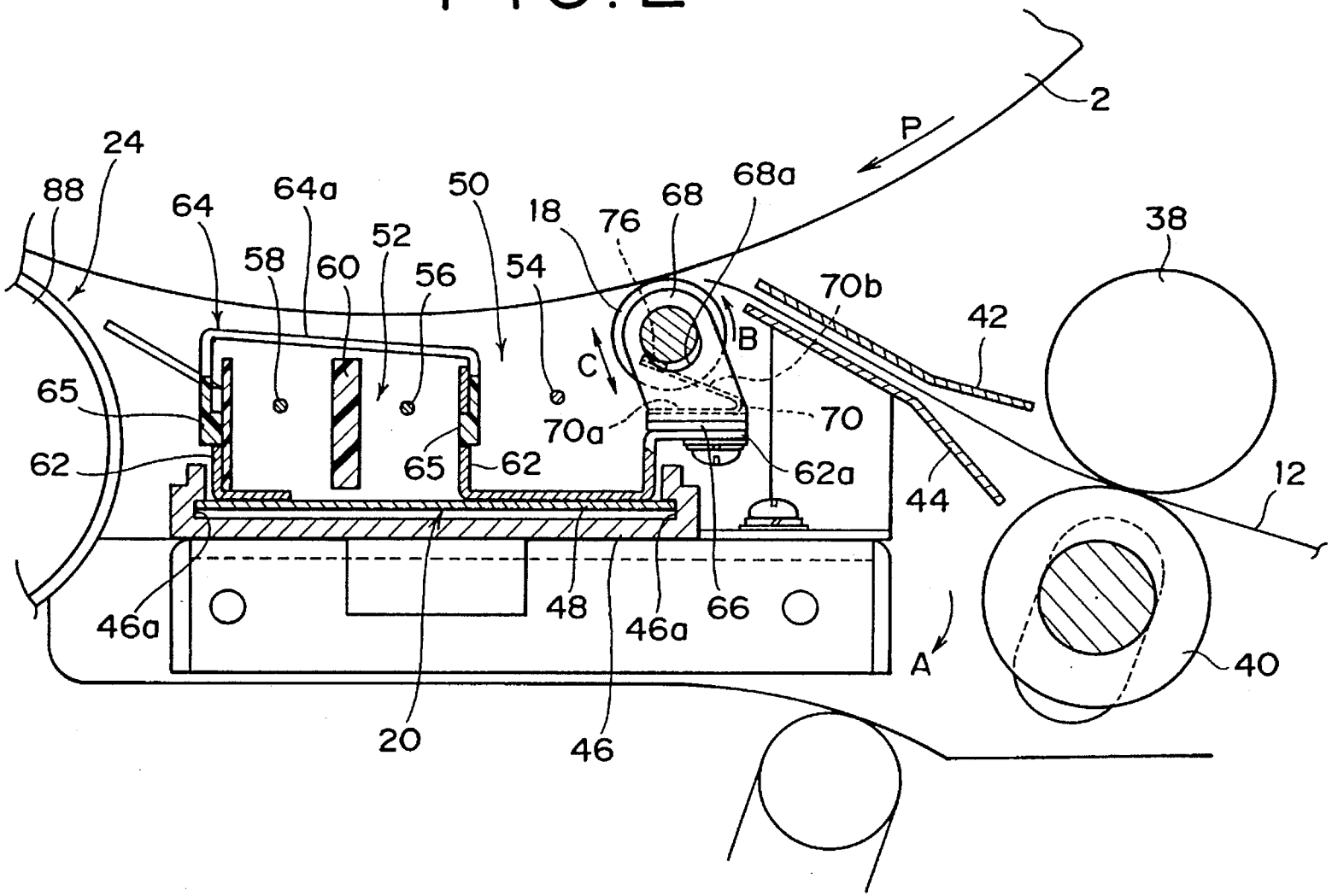
FIG. 2 is a partially sectional side view of a pressure roller and a transfer unit in the printer shown in FIG. 1.

A plurality of sheets of paper 12 stacked on a tray 10 are fed one by one by a feed roller 14 and supplied through a feed path 16 to the photosensitive drum 2 for the purpose of transferring of the toner image. As shown in FIG. 2, the paper 12 fed by a pair of feed rollers 38 and 40 is guided by an upper chute 42 and a lower chute 44 to come between the photosensitive drum 2 and a pressure roller or contact roller 18 for pressing the paper 12 against an outer circumference of the photosensitive drum 2. A first surface of the paper 12 supplied to the downstream side of the pressure roller 18 is brought into electrostatic contact with the outer circumference of the photosensitive drum 2 by a transfer unit 20 for applying DC corona discharge with a polarity reverse to that of the toner image from a second surface of the paper 12. At the same time, the toner image on the photosensitive drum 2 is transferred to the first surface of the paper 12 and electrostatically attached thereto. A residual toner on the photosensitive drum 2 after transferring the toner image is removed from the photosensitive drum 2 by a cleaner 22. Thus, one print cycle is ended.

The paper 12 onto which the toner image has been transferred is separated from the photosensitive drum 2 by an air suction type feed belt unit 24 and fed by the feed belt unit 24 in a direction depicted by an arrow Q in FIG. 1 to under a fuser 28 for fixing the toner image formed on the paper 12. The fuser 28 is constructed of a flash fusing system employing a xenon lamp, for example. The paper 12 under the fuser 28 is fed by a plurality of air suction type feed rollers 26 each having a plurality of suction openings **26*a*. In the case of printing on only the first surface of the paper 12, the paper 12 after fixing of the toner image is ejected by a pair of eject rollers 30** to a stacker (not shown).

In the case of printing on both the first and second surfaces of the paper 12, the paper 12 after fixing of the toner image is introduced into a paper inverting mechanism 34 by operating a baffle plate 32 as shown in FIG. 1 and inverted in feeding direction by the paper inverting mechanism 34. The paper 12 thus inverted is supplied through an inversion path 36 to an interface between the photosensitive drum 2 and the pressure roller 18. The paper inverting mechanism is well known and a mechanism disclosed in Japanese Laid-open Patent No. 1-150669 can be employed. In fixing the toner image on the first surface of the paper 12 by the fuser 28, the paper 12 is dried to be hardened and wrinkled. This is especially true when employing a flash fusing system. Accordingly, it is difficult to bring the inverted paper 12 into close contact with the outer circumference of the photosensitive drum 2 only by applying the DC corona discharge by the transfer unit 20 from the first surface of the inverted paper 12. To cope with this problem, the pressure roller 18 is provided on the upstream side of the transfer unit 20 according to the present invention. Owing to the provision of the pressure roller 18, the inverted paper 12 is pressed against the outer circumference of the photosensitive drum 2 and closely contacted thereto just before fed to the transfer unit 20, thereby improving the transfer characteristic of the toner image. Thus, the pressure roller 18 is effective especially in the case of printing on both surfaces of the paper 12.

Detailed structures of the transfer unit 20 and the pressure roller 18 will now be described with reference to FIG. 2. A guide member 46 is mounted to a body of the printer so as to be pivotable about an axis parallel to an axial direction of the pressure roller 18. The transfer unit 20 is slidably engaged with the guide member 46. More specifically, the transfer unit 20 has a conductive shield 62 and a guide plate 48 fixed to the conductive shield 62. On the other hand, the guide member 46 has a pair of guide grooves 46*a* extending along the axial direction of the pressure roller 18. The guide plate 48 is slidably engaged at its opposite side edges with the guide grooves 46*a* of the guide member 46. Thus, the transfer unit 20 is slidably engaged with the guide member 46.

Figure 4:
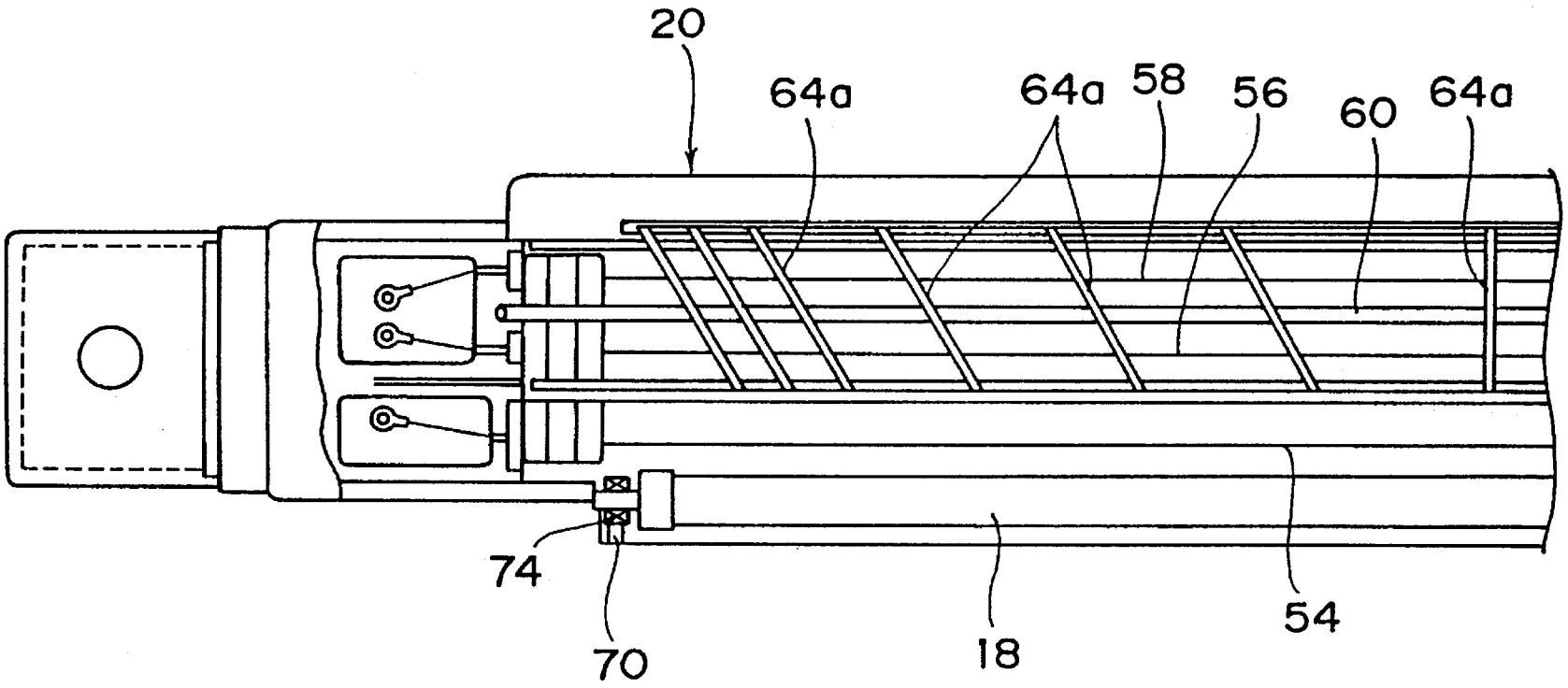
FIG. 4 is a plan view of the transfer unit shown in FIG. 2.

The transfer unit 20 is constituted of a transfer corotron 50 and a separation corotron 52 integrated with the transfer corotron 50. The transfer corotron 50 has a discharge wire 54 to which a DC voltage of 6–7 KV is applied. The separation corotton 52 has discharge wires 56 and 58 to which a DC superimposed AC voltage of about 12 KV is applied. A partition wall 60 formed of resin is provided between the discharge wires 56 and 58. A guide member 64 formed of resin is mounted on the conductive shield 62 of the separation corotron 52. As shown in FIG. 2, the guide member 64 is of a substantially U-shaped configuration as viewed in side elevation. The guide member 64 is formed at its opposite ends with a plurality of projections 65 adapted to engage a plurality of holes formed through the shield 62. Thus, the guide member 64 is mounted on the shield 62. As shown in FIG. 4, the guide member 64 is substantially open on its upper side so as to form a plurality of bar-shaped guiding portions 64*a* arranged in spaced relationship from each other. The bar-shaped guiding portions 64*a* of the guide member 64 serve to guide the paper 12 passing thereover.

Figure 3:
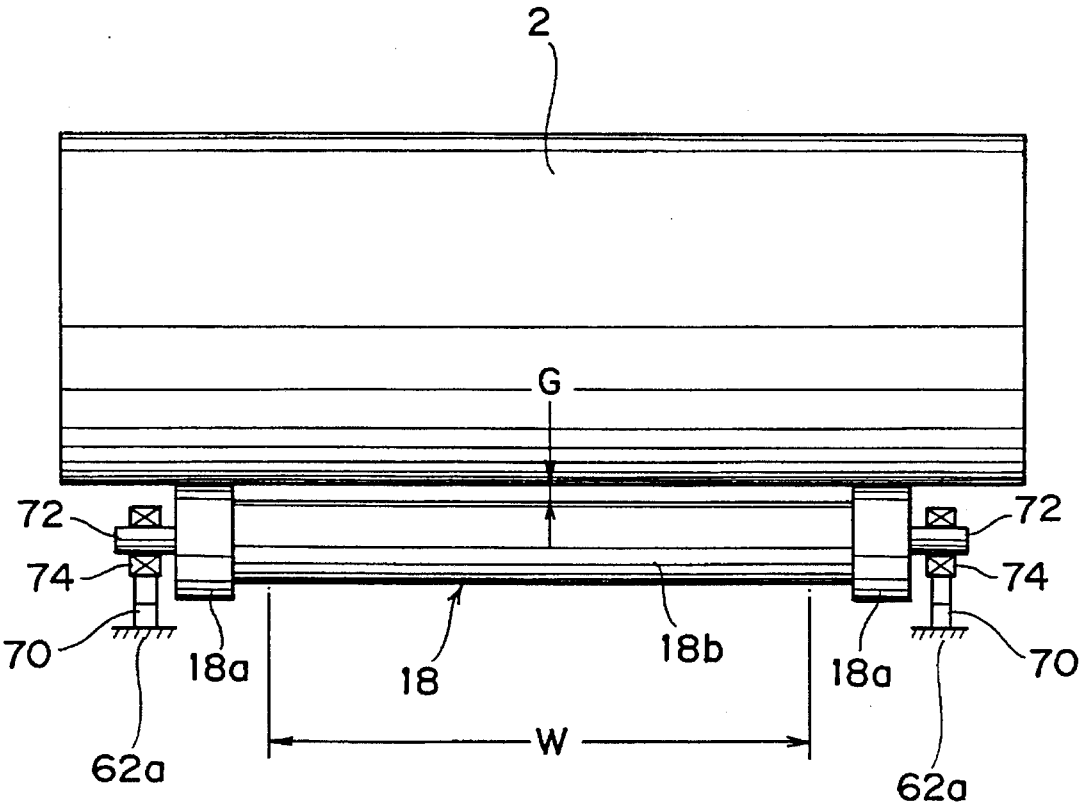
FIG. 3 is a schematic side view of the pressure roller shown in FIG. 2.

The conductive shield 62 of the transfer corotron 50 is formed with an extended portion 62*a* for mounting thereon a pair of brackets 68 through a pair of cushion members 66. Each cushion member 66 is formed of cushion rubber having a hardness of about 90. Each bracket 68 has an elongated hole 68*a*, and a pair of bearings 74 are respectively inserted in the elongated holes 68*a* of the brackets 68 so as to be movable in a direction depicted by an arrow C in FIG. 2. As shown in FIG. 3, a shaft 72 of the pressure roller 18 is rotatably supported at its opposite end portions by the bearings 74. A pair of V-shaped leaf springs 70 are respectively mounted on the brackets 68 so as to upwardly bias the bearings 74. Each V-shaped leaf spring 70 has a fixed arm 70*a* fixed to the corresponding bracket 68 and a movable arm 70*b* abutting against the corresponding bearing 74 so as to be elastically deformed. Thus, the pressure roller 18 is resiliently urged against the photosensitive drum 2 by the leaf springs 70 through the bearings 74. A biasing force of each leaf spring 70 is set to about 200 gf. Since the brackets 68 supporting the pressure roller 18 are mounted on the extended portion 62 of the shield 62 through the cushion members 66, vibration of the pressure roller 18 is prevented from being transmitted to the paper 12, thereby preventing nonuniformity of print on the paper 12. Further, as shown in FIG. 2, an additional cushion member 76 is attached to an end portion of the movable arm 70*b* of each leaf spring 70, thereby further improving the vibration isolating effect.

As shown in FIG. 3, the pressure roller 18 is preferably of a stepped configuration. If the pressure roller 18 is a uniformly cylindrical roller, there will arise filming of the photosensitive drum 2 and staining of the paper 12. Owing to the above configuration of the pressure roller 18, the above problem can be solved. More specifically, a pair of large diameter portions 18*a* are formed at the opposite end portions of the pressure roller 18 so as to be axially spaced a distance larger than a maximum paper width W, and a small diameter portion 18b is formed between the pair of large diameter portions 18*a*. The difference or gap G in diameter between each large diameter portion 18*a* and the small diameter portion 18*b* is set to be smaller by about 30 μm than the thickness of the paper 12.

Accordingly, when the paper 12 is not supplied between the photosensitive drum 2 and the pressure roller 18, the large diameter portions 18*a* of the pressure roller 18 are kept in contact with the outer circumference of the photosensitive drum 2 as shown in FIG. 3. On the other hand, when the paper 12 is supplied between the photosensitive drum 2 and the pressure roller 18, the paper 12 is interposed between the photosensitive drum 2 and the small diameter portion 18*b* and is fed by rotation of the pressure roller 18. At this time, the large diameter portions 18*a* of the pressure roller 18 come to separation from the photosensitive drum 2 because the thickness of the paper 12 is larger than the gap G between each large diameter portion 18*a* and the small diameter portion 18*b*. In this manner, the small diameter portion 18*b* having an axial length larger than the maximum paper width W is always kept in separation from the photosensitive drum 2, so that the filming of the photosensitive drum 2 and the staining of the paper 12 can be prevented.

Figure 5:
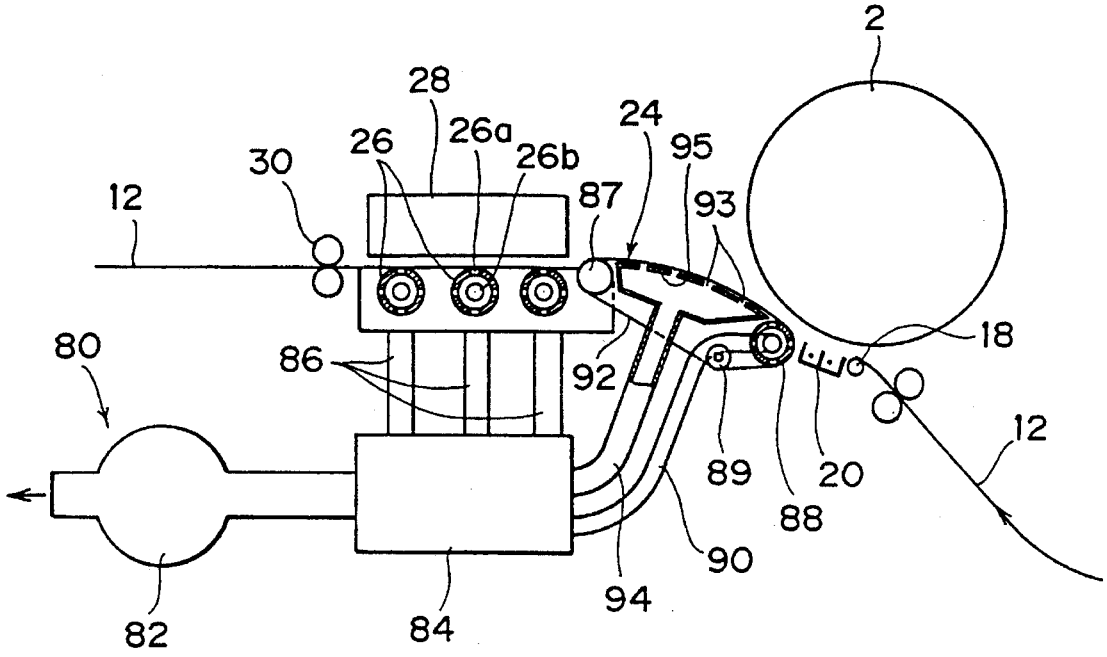
FIG. 5 is a partially sectional side view of an air suction mechanism in the printer shown in FIG. 1.
Figure 6:
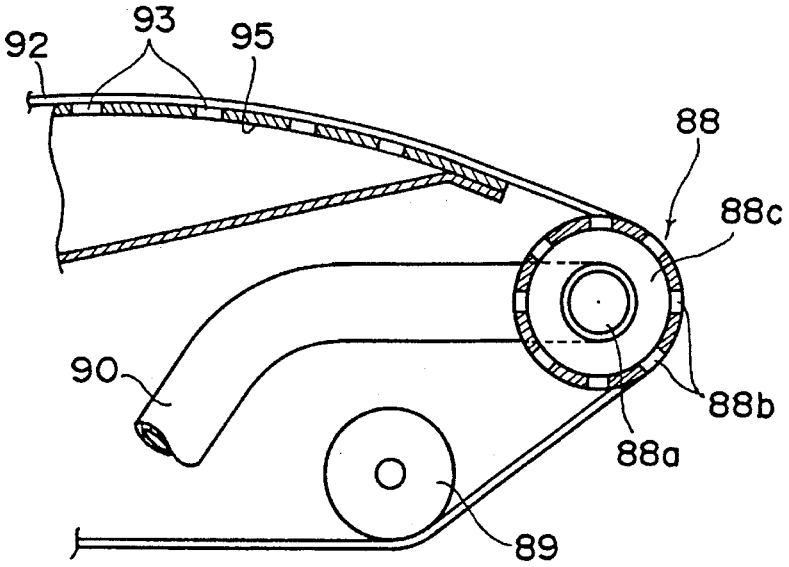
FIG. 6 is an enlarged sectional view of a part of an air suction type feed belt unit in the printer shown in FIG. 1.

Referring to FIG. 5, reference numeral 80 generally designates an air suction mechanism for the air suction type feed belt unit 24 and the feed rollers 26. As similar to the mechanism disclosed in U.S. Pat. No. 5,031,002, the air suction mechanism 80 includes an exhaust blower 82, an air chamber 84 connected to the exhaust blower 82, and a plurality of ducts 86 connected to the air chamber 84 for respectively evacuating hollow shaft portions 26*b* of the feed rollers 26. The hollow shaft portions 26*b* are respectively communicated with the suction openings 26*a* of the feed rollers 26. The air suction mechanism 80 further includes a duct 90 connected to the air chamber 84 for evacuating a hollow shaft portion 88*a* of a pulley 88 constituting the feed belt unit 24. The feed belt unit 24 includes the pulley 88, two guide pulleys 87 and 89, a plurality of feed belts 92 wrapped around the pulley 88 and the guide pulleys 87 and 89 in such a manner as to be spaced from each other, and a guide support 95 provided between the pulley 88 and the guide pulley 87 for supporting the feed belts 92. The guide support 95 is formed with a plurality of slits 93 communicating with each space defined between adjacent ones of the feed belts 92. The air suction mechanism 80 further includes a duct 94 connected to the air chamber 84 for sucking the air through the slits 93 of the guide support 95 and the spaces of the feed belts 92. As best shown in FIG. 6, a plurality of suction openings 88*b* are formed on the outer circumference of the pulley 88 so as to respectively communicate through cavities 88*c* to the hollow shaft portion 88*a*.

When the exhaust blower 82 is operated, the paper 12 supported on the feed rollers 26 is attracted thereto by the suction air sucked through the ducts 86 and the suction openings 26*a*. Further, the paper 12 supported on the feed belts 92 of the feed belt unit 24 at its portion supported on the guide support 95 is attracted thereto by the suction air sucked through the duct 94, the slits 93 and the spaces of the feed belts 92. Further, the paper 12 fed to the pulley 88 is attracted to the feed belts 92 wrapped around the pulley 88 by the suction air sucked through the duct 90 and the suction openings 88*b*.

Accordingly, after the charged condition of the paper 12 to which the toner image has been transferred from the photosensitive drum 2 by the transfer corotron 50 is neutralized in polarity by the separation corotron 52, the paper 12 is attracted to the feed belts 92 wrapped around the pulley 88 of the feed belt unit 24 by the suction air generated by the air suction mechanism 80, and is therefore separated from the photosensitive drum 2. Thereafter, the paper 12 is fed by the feed belts 92 supported on the guide support 95 of the feed belt unit 24 and the feed rollers 26 under the sucked condition effected by the air suction mechanism 80.

In the preferred embodiment, the paper 12 is pressed against the outer circumference of the photosensitive drum 2 by the pressure roller 18. Accordingly, it is preferable that a feed speed of the feed belt unit 24 is set to be identical with a peripheral speed of the photosensitive drum 2. The pressure roller 18 is formed of a rubber material having a hardness of 80 or more, such as silicone rubber, EPDM, or urethane rubber. Since the pressure roller 18 is constructed integrally with the transfer unit 20, the pressure roller 18 can be drawn together with the transfer unit 20 to be removed out of the printer body, and can be easily cleaned. In drawing the pressure roller 18 together with the transfer unit 20, the guide member 46 is pivoted by a predetermined amount in a direction depicted by an arrow A in FIG. 2, so as to prevent that the pressure roller 18 will slip on the outer circumference of the photosensitive drum 2.

Referring to FIGS. 7 to 11, another embodiment of the present invention will be described in detail. In the description of this embodiment, those component parts essentially the same as those in the above described embodiment will be denoted like reference numerals and description thereof will be omitted to avoid duplication. The present embodiment will be applicable to the printer shown in FIG. 1 substituting a paper guide means for the pressure roller 18.

Figure 7:
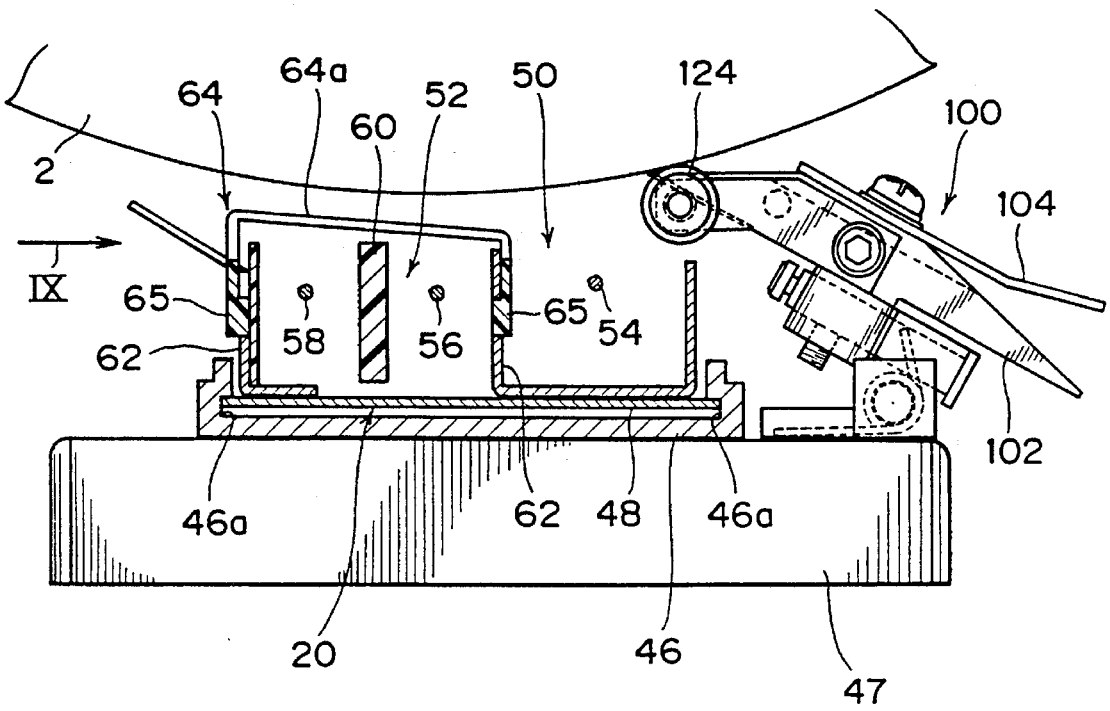
FIG. 7 is a similar to FIG. 2 but showing another embodiment of the present invention.
Figure 10:
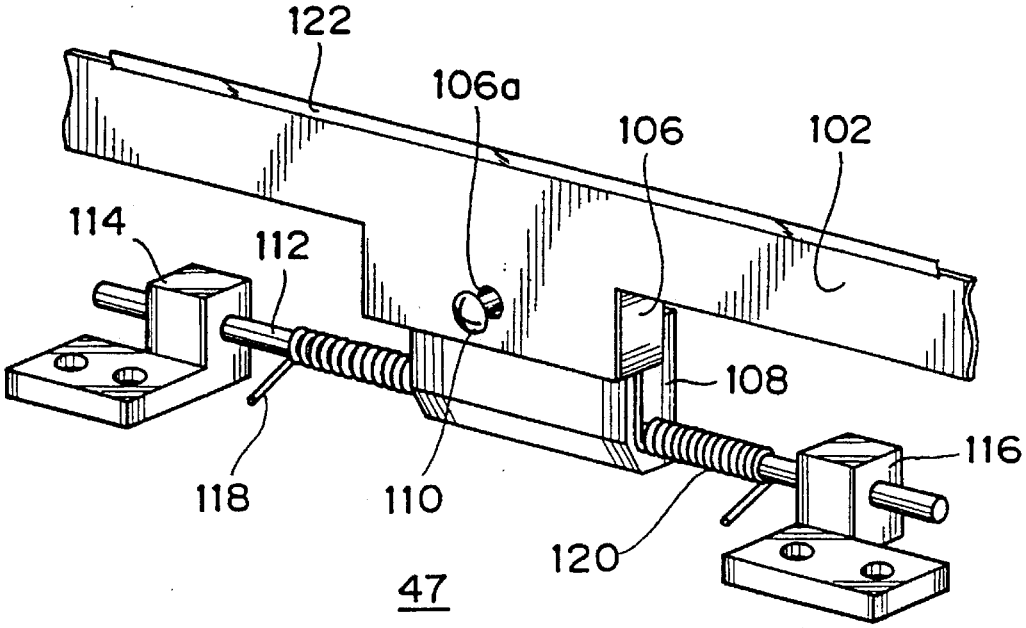
FIG. 10 is a perspective view showing a mounting structure of a lower paper guide.

Referring first to FIG. 7, a paper guide means 100 is provided upstream side of the transfer unit 20. The paper guide means 100 includes a lower paper guide 102 and an upper paper guide 104 fixedly secured to the lower paper guide 102 to define a paper path between the lower and upper paper guides 102 and 104. Both the paper guides 102 and 104 are made of stainless steel. As best shown in FIG. 10, the lower paper guide 102 is welded or otherwise fixedly secured to a block 106 which in turn is pivotally mounted to a block 108 by inserting a shaft 110 through holes 106*a* and 108*a* formed in the blocks 106 and 108, respectively.

Figure 11:
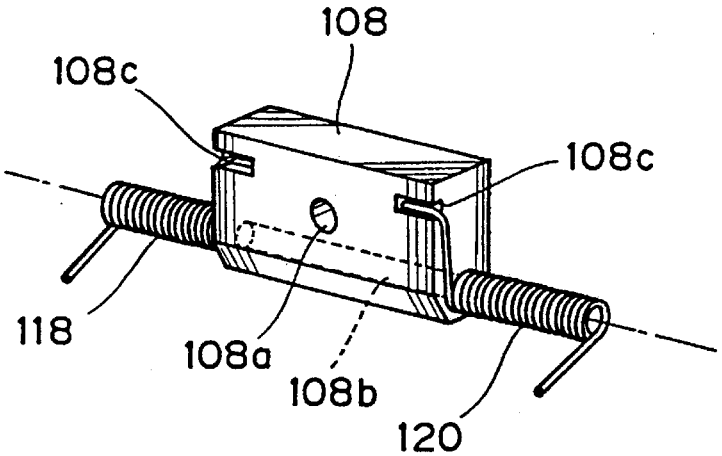
FIG. 11 is a perspective view of a block employed in the mounting structure of FIG. 10 with ends of coil springs received in grooves.

As shown in FIG. 11, the block 108 has formed therein holes 108*a* and 108*b* and a pair of grooves 108*c* for receiving ends of coil springs 118 and 120. Referring back to FIG. 10, a pair of brackets 114 and 116 are fixedly secured to a stay 47 which in turn is fixedly secured to a main frame of the printer. A shaft 112 is inserted through the hole 108*b* of the block 108 and is rotatably supported by the brackets 114 and 116. The coil springs 118 and 120 are mounted on the shaft 112 to bias the leading end of the lower paper guide 102 toward the photosensitive drum 2. A film guide 122 is bonded to the leading end of the lower paper guide 102. The film guide 122 has a thickness of about 125 μm and is made of polyester for example.

Figure 8:
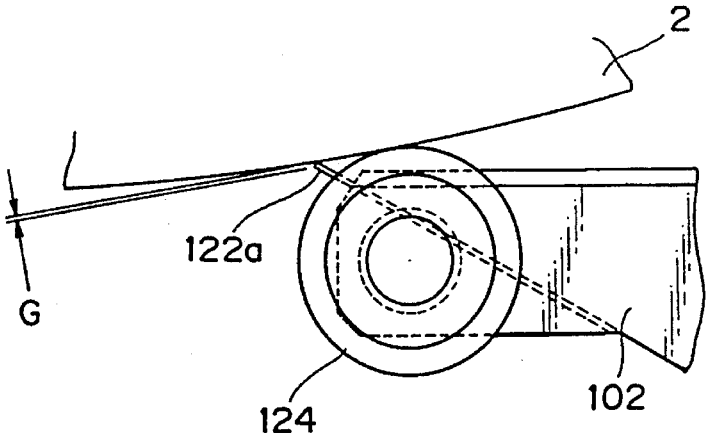
FIG. 8 is an enlarged side view showing a leading end portion of a lower paper guide and a regulating roller rotatably mounted thereto.
Figure 9:
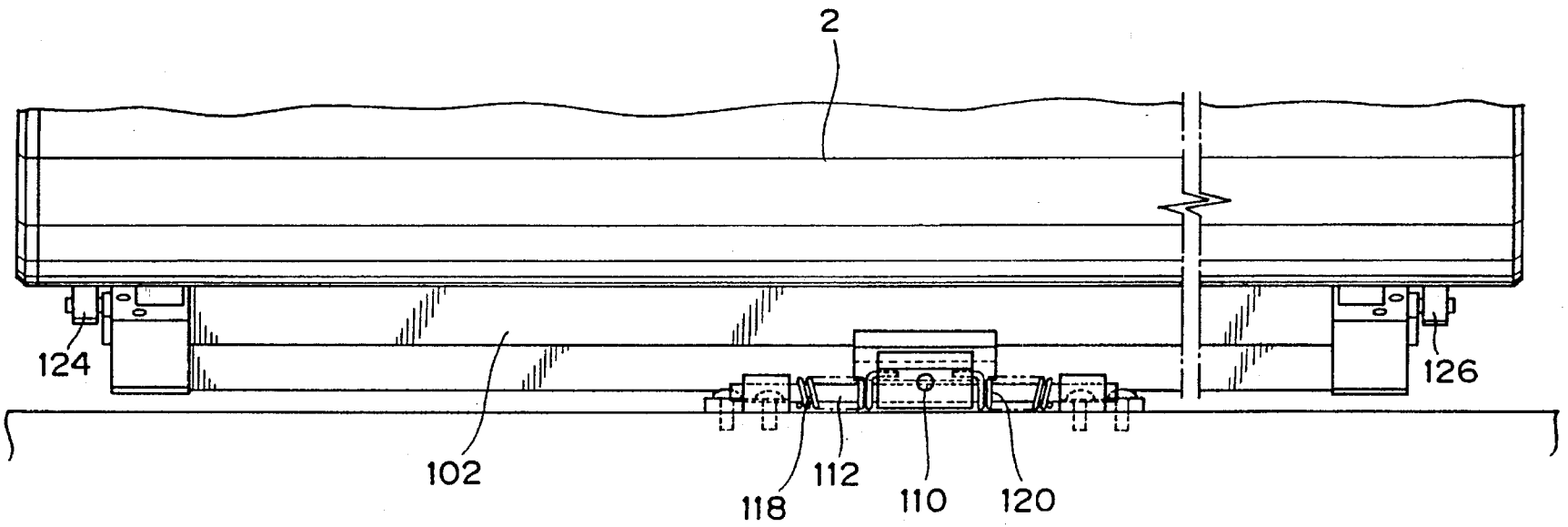
FIG. 9 is a view as viewed from a direction of an arrow IX with the transfer unit being omitted or taken out.

As shown in FIG. 9, a pair of regulating rollers 124 and 126 are mounted for rotation to leading end portions on both sides of the lower paper guide 102 to regulate a gap G between the drum 2 and the leading end 122*a* of the film guide 122 to be less than a thickness of the sheet of paper 12 (Refer to FIG. 8). The gap G is for example regulated to 0.75±0.25 μm. The regulating rollers 124 and 126 are urged by the coil springs 118 and 120 to be in rolling contact with the drum 2 to define the gap G when the paper 12 is not fed. When the paper 12 is fed, however, the regulating rollers 124 and 126 are moved away from the drum 2 against the biasing force of the coil springs 118 and 120 to allow feeding of the paper 12. When the paper 12 is being fed, the gap G becomes equal to the thickness of the paper. Accordingly, biasing forces of the coil springs 118 and 120 must be weak enough to allow the lower paper guide 102 to move away from the drum 2 when the paper 12 is introduced between the drum and the leading end 122*a* of the film guide 122.

Since the paper guide means 100 of the present embodiment is pivotally mounted about the shaft 110 extending perpendicular to the axis of the drum 2, it is possible to absorb an eccentric rotation of the drum 2 in axial direction thereby allowing the regulating rollers 124 and 126 to be always in rolling contact with the drum 2 when the sheet of paper is not being fed. With the provision of the paper guide means 100 upstream of the transfer unit 20, the paper 12 is pressed against the outer circumference of the drum 2 and closely contacted thereto just before fed to the transfer unit 20, thereby improving transfer characteristic of the toner image.

Since in this embodiment, transfer coronas discharged from the wire 54 can be supplied directly from below without an obstruction to the press-contacting portion of the paper 12 with the drum 2, the paper 12 will be electrostatically adhered to the drum 2, thus improving transfer characteristic of the toner image.

As described above, according to the present invention, the pressure roller 18 or paper guide means 100 is provided on the upstream side of the transfer unit so as to positively press the paper against the outer circumference of the photosensitive drum. Accordingly, in the case of printing on both surfaces of the paper, the pressure roller 18 or the paper guide means 100 is especially effective. That is, when the toner image on the first surface of the paper is fixed, the paper is hardened to be wrinkled. However, the wrinkled paper having the fixed toner image on the first surface is positively pressed against the outer circumference of the photosensitive drum by the pressure roller 18 or the paper guide means 100 before fed to the transfer unit again. Therefore, the wrinkle of the paper can be removed by the pressure roller or the paper guide means to thereby realize good transfer of the toner image onto the second surface of the paper.

Although the photosensitive drum is employed as the electrostatic latent image retaining body in the above preferred embodiment, an endless photosensitive belt may be substituted for the photosensitive drum according to the present invention. Further, although the present invention has been applied to the electrophotographic printer in the above preferred embodiment, it may be similarly applied to an electrophotographic copying machine.

What is claimed is:

1. An image forming apparatus, comprising:

an electrostatic latent image retaining body;

means for forming an electrostatic latent image on said retaining body;

means for developing said electrostatic latent image to form a toner image on said retaining body;

transfer means for transferring said toner image from said retaining body to a sheet of paper;

means for separating from said retaining body said sheet of paper to which said toner image has been transferred by said transfer means;

means for fixing said toner image on said sheet of paper;

a pressure roller, rotatably and elastically provided on an upstream side of said transfer means, for pressing said sheet of paper against said retaining body;

biasing means, interposed between said pressure roller and said transfer means, for directly biasing said pressure roller onto said sheet of paper against said retaining body from the time said sheet of paper is fed between said pressure roller and said retaining body;

paper inverting means for inverting feeding direction of said sheet of paper after toner image on a first surface of said sheet of paper is fixed by said fixing means;

inversion path means for supplying said sheet of paper inverted by said paper inverting means to a position between said retaining body and said pressure roller; and a cushion means, interposed between said pressure roller and said transfer, unit for absorbing vibrations of said pressure roller.

2. An image forming apparatus according to claim 1, wherein said transferring means and said separating means are integrated to form a transfer unit, said transfer unit being slidably mounted in a predetermined position.

3. An image forming apparatus according to claim 2, wherein said transferring means comprises DC corona discharging means, and said separating means comprises AC corona discharging means.

4. An image forming apparatus according to claim 2, wherein said transfer unit is fixedly positioned relative to said retaining body while the apparatus is in operation.

5. An image forming apparatus according to claim 1, wherein said biasing means elastically biases said pressure roller against said retaining body to thereby provide a pressure roller which is only frictionally driven by said retaining body.

6. An image forming apparatus, comprising;

an electrostatic latent image retaining body;

means for forming an electrostatic latent image on said retaining body;

means for developing said electrostatic latent image to form a toner image on said retaining body;

non-contact type corona discharge transfer means for transferring said toner image from said retaining body to a sheet of paper;

means for separating from said retaining body said sheet of paper to which said toner image has been transferred by said transfer means;

means for fixing said toner image on said sheet of paper;

a pressure roller, rotatably and elastically provided on an upstream side of said transfer means, for pressing said sheet of paper against said retaining body from the time said sheet of paper is fed between said pressure roller and said retaining body, wherein said pressure roller comprises a pair of large diameter portions spaced from each other and adapted to contact said retaining body at opposite end portions thereof, and a small diameter portion extending between said large diameter portions, and wherein a difference in diameter between each of said large diameter portions and said small diameter portion is set to be slightly smaller than a thickness of said sheet of paper;

biasing means interposed between said pressure roller and said transfer means, for directly biasing said pressure roller onto said sheet of paper against said retaining body; and a cushion means, interposed between said pressure roller and said transfer unit, for absorbing vibrations of said pressure roller.

7. An image forming apparatus according to claim 6 further comprising paper feeding means for feeding said sheet of paper separated from said retaining body by said separating means, wherein said retaining body comprises a photosensitive drum adapted to be rotatably driven, and a feed speed of said paper feeding means is set to be substantially identical with a peripheral speed of said photosensitive drum.

8. An image forming apparatus according to claim 6, wherein said biasing means elastically biases said pressure roller against said retaining body to thereby provide a pressure roller which is only frictionally driven by said retaining body.

9. An image forming apparatus, comprising:

an electrostatic latent image retaining body;

means for forming an electrostatic latent image on said retaining body;

means for developing said electrostatic latent image to form a toner image on said retaining body;

transfer means for transferring said toner image from said retaining body to a sheet of paper;

means for separating from said retaining body said sheet of paper to which said toner image has been transferred by said transfer means;

means for fixing said toner image on said sheet of paper;

paper guide means, provided on an upstream side of said transfer means, for guiding said sheet of paper to contact with said electrostatic latent image retaining body;

a pair of gap regulating means, provided at leading end portions of said paper guide means on both sides thereof, for regulating a gap between said retaining body and a leading end of said paper guide means to become less than a thickness of said sheet of paper;

biasing means for directly biasing the leading end of said paper guide means onto said sheet of paper against said retaining body from the time said sheet of paper is fed between said pressure roller and said retaining body, a biasing force of said biasing means being weak enough to allow said paper guide means to move away from said retaining body against the biasing force of said biasing means when said sheet of paper is introduced between said retaining body and the leading end of said paper guide means; and a film guide bonded to the leading end portion of said paper guide means, wherein said pair of gap regulating means regulate a gap between said retaining body and a leading end of said film guide to become less than a thickness of said sheet of paper.

10. An image forming apparatus according to claim 9 further comprising:

paper inverting means for inverting feeding direction of said sheet of paper after toner image on a first surface of said sheet of paper is fixed by said fixing means; and inversion path means for supplying said sheet of paper inverted by said paper inverting means to said paper guide means.

11. An image forming apparatus according to claim 9 further comprising:

means for pivotally mounting said paper guide means about a pivot axis which is generally perpendicular to an axis of said retaining body.

12. An image forming apparatus according to claim 11 wherein said electrostatic latent image retaining body is a photosensitive drum and each of gap regulating means comprises a roller rotatably mounted to said paper guide means, said roller being in contact with said photosensitive drum to define the gap.

13. An image forming apparatus, comprising:

an electrostatic latent image retaining body;

means for forming an electrostatic latent image on said retaining body;

means for developing said electrostatic latent image to form a toner image on said retaining body;

transfer means for transferring said toner image from said retaining body to a sheet of paper;

means for separating from said retaining body said sheet of paper to which said toner image has been transferred by said transfer means;

means for fixing said toner image on said sheet of paper;

paper guide means, provided on an upstream side of said transfer means, for guiding said sheet of paper to contact with said electrostatic latent image retaining body;

a pair of gap regulating means, provided at leading end portions of said paper guide means on both sides thereof, for regulating a gap between said retaining body and a leading end of said paper guide means to become less than a thickness of said sheet of paper;

biasing means for directly biasing the leading end of said paper guide means onto said sheet of paper against said retaining body from the time said sheet of paper is fed between said pressure roller and said retaining body, a biasing force of said biasing means being weak enough to allow said paper guide means to move away from said retaining body against the biasing force of said biasing means when said sheet of paper is introduced between said retaining body and the leading end of said paper guide means;

means for pivotally mounting said paper guide means about a pivot axis which is generally perpendicular to an axis of said retaining body; and a film guide bonded to the leading end portion of said paper guide means, wherein said pair of gap regulating means regulate a gap between said retaining body and a leading end of said film guide to become less than a thickness of said sheet of paper.

* * * * *